US007372350B2

(12) United States Patent
Chida et al.

(10) Patent No.: US 7,372,350 B2
(45) Date of Patent: May 13, 2008

(54) ELECTROMAGNETIC RELAY

(75) Inventors: Yoshifumi Chida, Iwate (JP); Kei Chiba, Iwate (JP); Tatsumi Ide, Iwate (JP); Shigeru Kasai, Iwate (JP)

(73) Assignees: NEC Tokin Corporation, Miyagi (JP); NEC Tokin Iwate, Ltd., Iwate (JP)

( * ) Notice: Subject to any disclaimer, the term of this patent is extended or adjusted under 35 U.S.C. 154(b) by 415 days.

(21) Appl. No.: 11/137,453

(22) Filed: May 26, 2005

(65) Prior Publication Data

US 2005/0264386 A1 Dec. 1, 2005

(30) Foreign Application Priority Data

May 28, 2004 (JP) ..... 2004-158951

(51) Int. Cl.
*H01H 67/02* (2006.01)

(52) U.S. Cl. ..... 335/128; 335/78; 335/124

(58) Field of Classification Search ..... 335/128–130, 335/78–86, 124
See application file for complete search history.

(56) References Cited

U.S. PATENT DOCUMENTS

| | | | | |
|---|---|---|---|---|
| 3,155,790 A | | 11/1964 | Lemonnier | |
| 5,025,238 A | * | 6/1991 | Matuo et al. | 335/128 |
| 5,973,011 A | * | 10/1999 | Noack et al. | 514/742 |
| 6,140,895 A | * | 10/2000 | Dittmann et al. | 335/80 |
| 6,448,877 B1 | | 10/2002 | Harayama et al. | 335/78 |

FOREIGN PATENT DOCUMENTS

| | | |
|---|---|---|
| DE | 103 24 747 A1 | 8/2000 |
| DE | 103 24 747 A1 | 1/2004 |
| JP | 2002-329447 | 11/2002 |

OTHER PUBLICATIONS

Translation of a Notification of the First of Office Action from State Intellectual Property Office of People's Republic of China, issued on Oct. 13, 2006, pp.1-3.
Notification of the First of Office Action from State Intellectual Property Office of People's Republic of China in Chinese, issued on Oct. 13, 2006, pp. 1-2.
The text of the Fist Office action in English, Chinese and Japanese, pp.1-7.
European Search Report dated Sep. 5, 2005.

* cited by examiner

*Primary Examiner*—Elvin Enad
*Assistant Examiner*—Bernard Rojas
(74) *Attorney, Agent, or Firm*—Whitham Curtis Christofferson & Cook, P.C.

(57) ABSTRACT

An electromagnetic relay is provided which is small in size and is capable of controlling two circuits of an ordinarily-open contact, which has a large current-carrying capacity and high interrupting capability, and which is excellent in resistance against shock and vibration. Movable contactors are held, through bow-shaped movable contactor springs, to two コ-shaped holding frames each being electrically separated and being mechanically connected via a card made of a highly heat-resistant resin in a card block. Thick-plate shaped movable contacts, which are attached to the movable contactors in a fixed manner, are electrically connected or disconnected to fixed contacts in a base block, in synchronization with operations of an armature of an electro-magnet block. In order to improve a current-carrying capability and interrupting capability, there are provided two pieces of ordinarily-open contacts which are connected in series to each other, and between which an interval is doubled, in each of two circuits.

14 Claims, 7 Drawing Sheets

ELECTROMAGNETIC RELAY

BACKGROUND OF THE INVENTION

1. Field of the Invention

The present invention relates to an electromagnetic relay and more particularly to the electromagnetic relay being suitable for control of a vehicle-mounted three-phase brushless motor.

The present application claims priority of Japanese Patent Application No. 2004-158951 filed on May 28, 2004, which is hereby incorporated by reference.

2. Description of the Related Art

In recent years, an operating method of power steering for an automobile is changing from a hydraulic type to an electric type with the aim of improving automobile fuel consumption. At present a steering method for controlling a DC (Direct Current) motor is used in electric power steering systems in most cases. However, electric power steering systems using a three-phase brushless motor increases as its application of electric power steering to an automobile having a large piston displacement increases. As a result, a switching device that can control three phases simultaneously or that can control only two phases out of three phases becomes necessary. For example, in order to control the three-phase motor, an electromagnetic relay is becoming very useful which can simultaneously control three phases at a midpoint (connection point) of star connection or can control only two phases. Prerequisites to the control of the electric power steering by the electromagnetic relay are a large current-carrying capability (which allows a current of, for example, 100A to flow) and an interrupting capability (which can interrupt a voltage and a current of, for example, 100A at 14V.) to provide torque for the motor. Additionally, in response to a high rate at which components are made electrical and electronic in an automobile, it is required that the electromagnetic relay is miniaturized further.

A conventional electromagnetic relay is disclosed in Japanese Patent Application Laid-open No. 2002-329447 in which a vehicle-mounted electromagnetic relay can be so configured as to be smaller in size. However, conventionally, a single electro-magnetic relay has not yet been known which has a current-carrying capability (which allows a current of, for example, 100A to flow) and an interrupting capability (which can interrupt a voltage and a current of, for example, 100A at 14V) being large enough for one electromagnetic relay to be able to control one three-phase brushless motor for electric power steering.

Also, at present, an electromagnetic relay designed to control the three-phase brushless motor is of a type having only one circuit with one ordinarily-open contact (which is called "1 FORM A-type"). One electromagnetic relay is used in each of, at least, two circuits out of three circuits to be used for control of the three-phase brushless motor or a plurality of electro-magnetic relays is used, in order to divide a current within the one circuit to be used for the control of the three-phase brushless motor, depending on a performance capability of the electromagnetic relay.

In current automobiles, due to miniaturization, high-density mounting, and cost reduction in various electronic components, the rate at which components are made electrical and electronic has increased. In other words, a present state is that the electromagnetic relay to be mounted on an automobile requires further miniaturization of its components, further improvement of accuracy in assembling the components, and further increases in productivity of the components, and cost reduction in the components.

When a plurality of electromagnetic relays each having only one circuit with one ordinarily-open contact is used for the control of the three-phase brushless motor, a ratio of the electromagnetic relays to occupy a space within a device using electrical and electronic components becomes greater, use of a plurality of electromagnetic relays does not meet a customer demand to provide a space-saving structure as much as possible for the devices made up of electrical and electronic components. Therefore, it is necessary that a single electromagnetic relay has two or more circuits each having the ordinarily-open contact, and a ratio of the single electromagnetic relay to occupy a space within a device using electrical and electronic components is smaller than a ratio of a plurality of electromagnetic relays, each having one circuit with one ordinarily-open contact, to occupy a space within the device using electrical and electronic components. In such an electromagnetic relay as described above, it is necessary that the ordinarily-open contact between the two circuits is kept in an insulated state and that an insulating member called a "card" is inserted between the two circuits. Additionally, in order to allow a current of 100A to flow, it is necessary that resistance across terminals is made as low as possible so that the resistance across the terminal is 1 m □ or less. To achieve this, by shortening a length of a current path for a current flowing through the electromagnetic relay as much as possible and by increasing a cross-sectional area of a current path as much as possible, resistance of a conductor must be low. Also, it is necessary that a contacting strength by which contacts are pressed against one another is made as great as possible and contact resistance among contacts is made low and is stable. It is also necessary that the electromagnetic relay can withstand shock and vibration of an automobile. Furthermore, the electromagnetic relay plays a role of breaking circuit connection in an abnormal state, and therefore it is required for the electromagnetic relay to be capable of interrupting a current of about 100A at 14V DC (Direct Current) as interrupting capability.

SUMMARY OF THE INVENTION

In view of the above, it is an object of the present invention to provide an electromagnetic relay which is small in size and is capable of controlling two circuits each having one ordinarily-open contact and of having a large current-carrying capacity and high interrupting capability and being excellent in resistance against shock and vibration.

According to a first aspect of the present invention, there is provided an electromagnetic relay including:

an electro-magnet block having an iron core around which a coil is wound, a yoke being attached to one end of the iron core, an armature that is placed in a position being opposite to another end of the iron core and is attracted by the energized iron core, and a hinge spring that supports the armature in such a manner that the armature is capable of rocking or swinging;

a card block which includes a pair of holding frames each being electrically separated and being mechanically connected by an insulating material, a pair of movable contactor springs being joined to the holding frames, a pair of movable contactors being joined to each of the movable contactor springs and each having at least one movable contact in a fixed manner, and a pair of release springs to return the movable contactors from an operating state to a released state; and a base block to support at least two fixed terminals each having a fixed contact and two coil terminals using an insulating material for a base; and wherein the at least two movable contacts of the card block are placed approximately in one plane and the at least two fixed contacts each are placed in positions facing a corresponding one of the at least two movable contacts on the base block, and the at least two movable contacts and the at least two fixed contacts are simultaneously opened and closed in synchronization with the rock or swing of the armature.

In the foregoing, a preferable mode is one that wherein includes:

the electro-magnet block having the iron core around which the coil is wound, an L-shape yoke being attached to one end of the iron core, an approximately <- shaped armature that is placed in a position being opposite to another end of the iron core and is attracted by the energized iron core, and the hinge spring that supports the armature in such a manner that the armature is capable of rocking or swinging;

the card block which includes a pair of ⊐-shaped holding frames each being electrically separated and being mechanically connected by the insulating material, a pair of the movable contactor springs being joined to the ⊐-shaped holding frames, a pair of the movable contactors being joined to each of the movable contactor springs and each having two movable contacts in a fixed manner, and a pair of release springs to return the movable contactors from an operating state to a released state; and the base block to support four fixed terminals each having a fixed contact and two coil terminals using an insulating material for a base; and wherein the four movable contacts of the card block are placed approximately in one plane and the four fixed contacts each are placed in positions facing a corresponding one of the four movable contacts on the base block, and the four movable contacts and four fixed contacts are simultaneously opened and closed in synchronization with the rock or swing of the armature.

Also, a preferable mode is one wherein the movable contactor spring is bow-shaped.

Also, a preferable mode is one wherein the movable contactor is made of a thick plate.

Also, a preferable mode is one wherein the movable contactor spring is attached in a center of the movable contactor.

In addition, a preferable mode is one wherein, in a portion in which the ⊐-shaped holding frames face each other is placed added portions being approximately orthogonal to surfaces including the ⊐-shaped portion.

Also, a preferable mode is one wherein each of the pair of release springs includes a first plate-like spring and a second plate-like spring and the first plate-like spring is attached in a fixed form to one arm portion of each of the ⊐-shaped holding frames and the second plate-like spring is attached in a fixed form to another arm portion of each of the ⊐-shaped holding frames and the first plate-like spring and the second plate-like spring are arranged in parallel and in a direction being reverse to each other.

Also, a preferable mode is one wherein one end of the first plate-like spring is supported in a fixed manner on the insulating material for the base and one end of the second plate-like spring is supported in a movable manner while being slid on a surface of the insulating material for the base.

Also, a preferable mode is one wherein a width of the first plate-like spring is larger than that of the second plate-like spring.

Also, a preferable mode is one wherein a length of the first plate-like spring is larger than that of the second plate.

Also, a preferable mode is one wherein the release spring is formed integrally with the movable contactor spring.

Also, a preferable mode is one wherein a position used to transfer a movement of the contactor to the card block is deviated to a side of one end of the second plate-like spring, on which a pair of movable supporting points is located, relative to a center point of the card block.

Also, a preferable mode is one wherein one end of a supporting terminal to fix the electro-magnet block to a base block is fixed to the L-shaped yoke and another end of the supporting terminal is inserted into the base block by pressing and in a fixed manner.

Furthermore, a preferable mode is one wherein the insulating material for connection is made of a highly heat-resistant resin, ceramic, glass, or composite of these materials.

With the above configuration, by mounting two circuits each having the ordinarily-open contact within one electromagnetic relay, an entire product can be made smaller in size, which enables the electromagnetic relay to be space-saving, when compared with a case in which two electromagnetic relays each having only one circuit with one ordinarily-open contact are mounted. In that case, two circuits each having the ordinarily-open contact can be electrically separated from each other since the respective holding frames that mount components making up circuits each having the ordinarily-open contact are combined through the insulating materials such as a highly heat-resistant resin, ceramic, glass, or composite of these materials.

Moreover, by mounting two ordinarily-open circuits as a set in one circuit in the electromagnetic relay, two contact intervals exist in series which are two times larger than ordinary intervals of the contact, thus improving the interrupting capability.

Also, in the card block, when the movable contact is pressed on the fixed contact in synchronization with operations of the armature, in order to obtain stable contacting resistance with the contact, it is necessary that the two ordinarily-open contacts mounted in one circuit are acted upon by the same contacting force. In an imbalanced state in which deviations occur in height between the two contacts due to variations in manufacturing and, as a result, one contact has high contacting force and another has low contacting force, stability in contacting resistance with the contact is impaired. To avoid this problem, according to the present invention, by coupling a center portion of the bow-shaped movable contactor spring to a center portion of the plate-shaped movable contact, the movable contact accommodates deviations in height between the contacts and stable contacting force can be applied between the two ordinarily-open contacts.

Also, by mounting two added portions bent approximately at right angles in a center portion of the ⊐-shaped holding frame made up of two arm portions and a center portion and by integrally forming the center portion of the pair of the ⊐-shaped holding frames with the two center portions being placed opposite to each other by using a highly heat-resistant resin, ceramic, glass, or composite of these materials, the holding frame that can withstand restoring force of the attached contact spring (movable contact) and release spring can be constructed.

By mounting the two release springs so that the two release springs are arranged in parallel in a direction being reverse to each other and one of the two springs is supported in a fixed manner and another of the two springs is supported in a movable manner, shock resistance, operational durability, required spring constant can be simultaneously satisfied. At this time, force to be applied to the spring on the fixed supporting side becomes larger than that to be applied to the spring on the movable supporting side. By making large a width of a spring plate on the fixed supporting side and small a width of a spring plate on the movable supporting side or making the spring on the fixed supporting side longer than that on the movable supporting side, the stress-balanced release spring can be obtained.

In the card block supported by the release springs arranged in parallel in a direction being reverse to each other, one of which is supported in a fixed manner and another of which is supported in a movable manner, and if its center portion of the card block is pressed, an equilibrium operation is not performed and a movable contact on the fixed side first starts to operate and operations becomes imbalanced, however, by pressing a portion being located on the movable supporting side, relative to a center point of the card block, a well-balanced equilibrium operation can be performed.

BRIEF DESCRIPTION OF THE DRAWINGS

The above and other objects, advantages, and features of the present invention will be more apparent from the following description taken in conjunction with the accompanying drawings in which:

FIG. 7A is a perspective view of the card block and FIG. 7B is a schematic diagram showing supporting points of the release spring and a pressure point of the card by an armature.

DETAILED DESCRIPTION OF THE PREFERRED EMBODIMENTS

Figure 1:
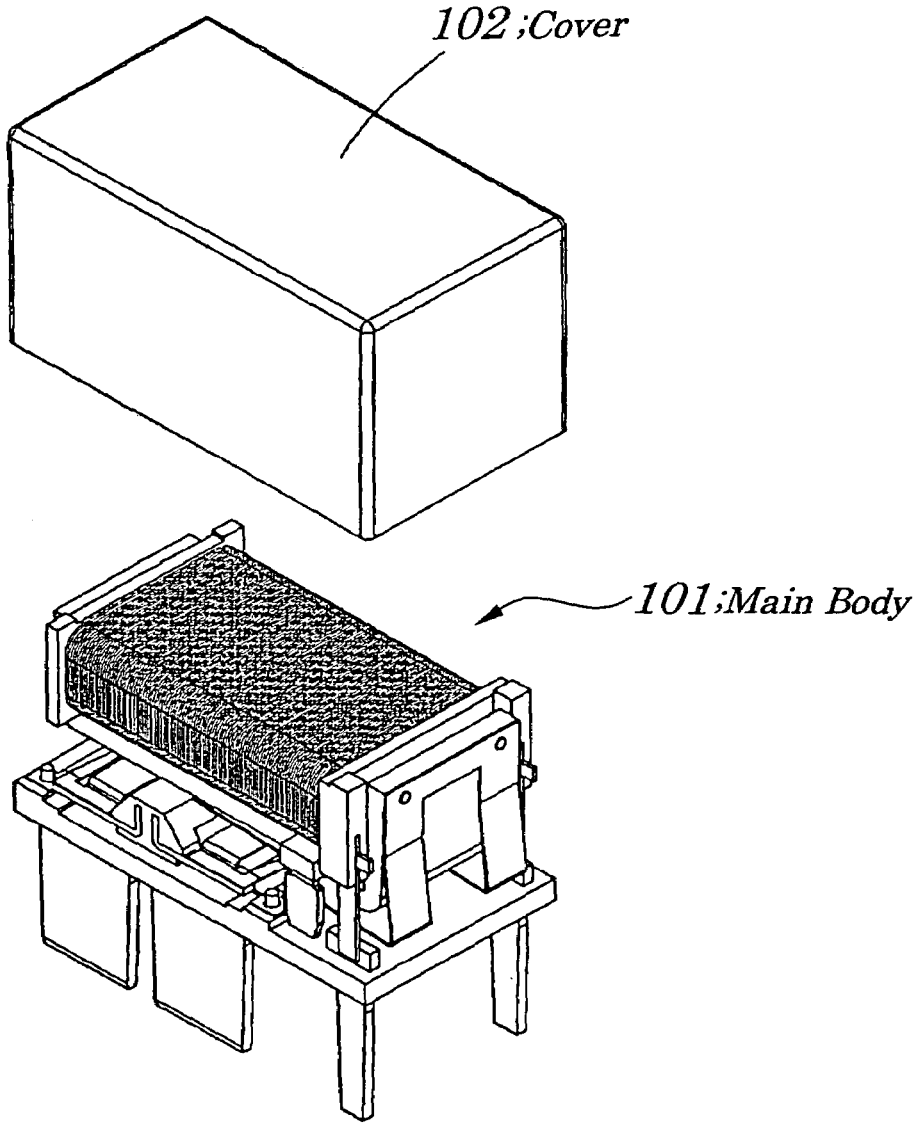
FIG. 1 is a perspective view of an electromagnetic relay according to a preferable embodiment of the present invention.
Figure 2:
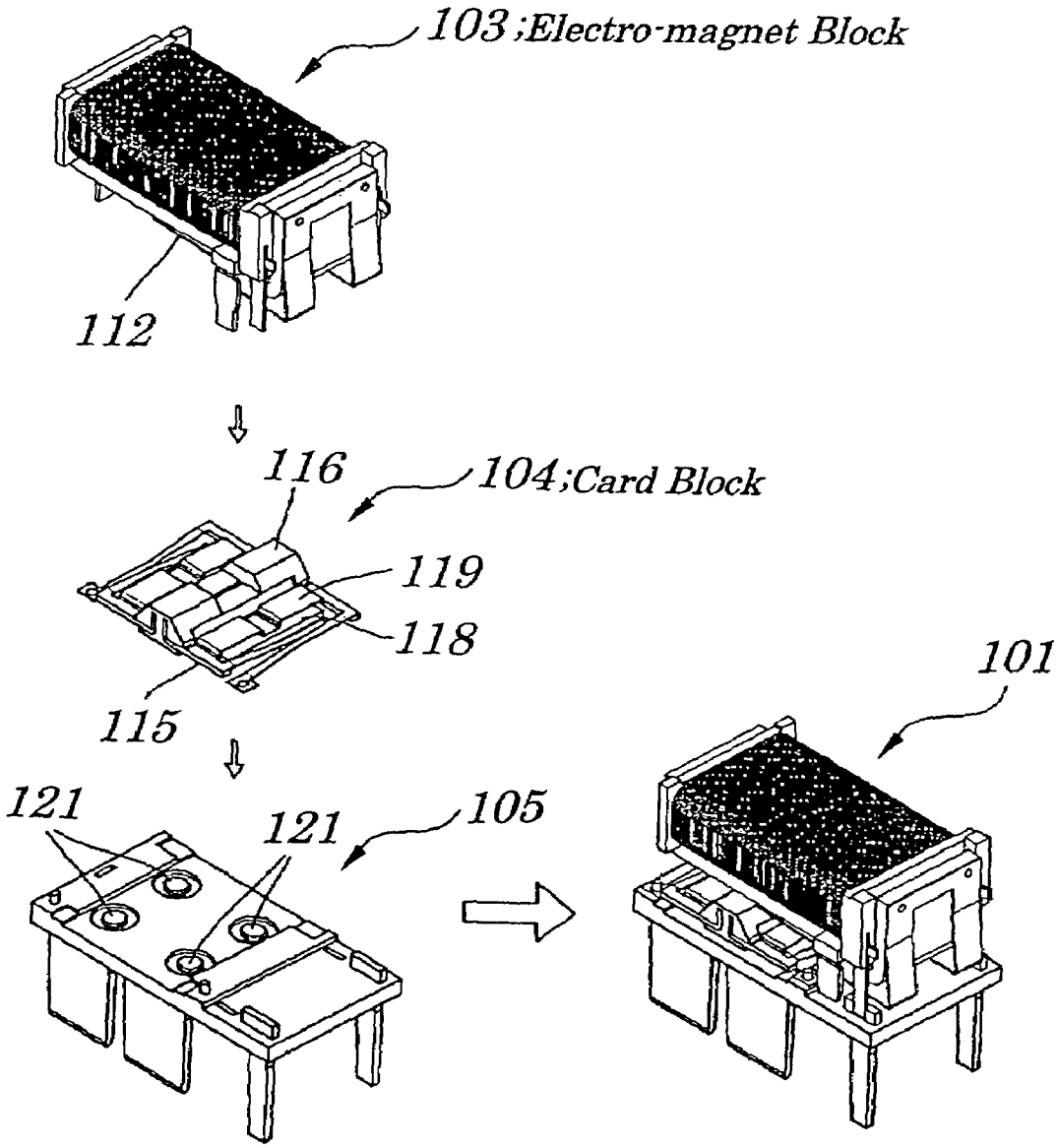
FIG. 2 is an exploded perspective view of a main body of the electromagnetic relay according to the same embodiment of the present invention.
Figure 3:
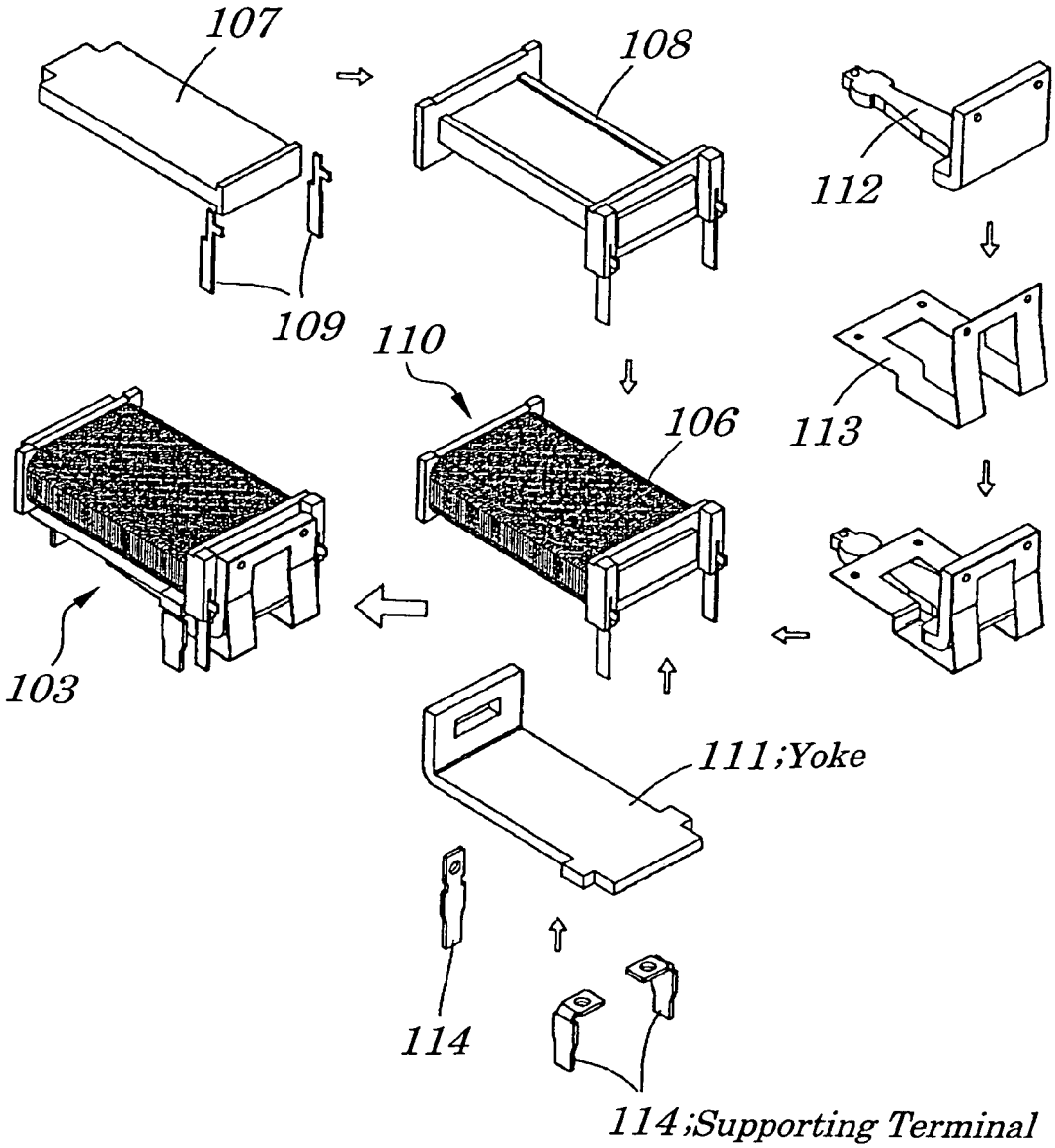
FIG. 3 is an exploded perspective view of an electro-magnet block according to the same embodiment of the present invention.
Figure 4:
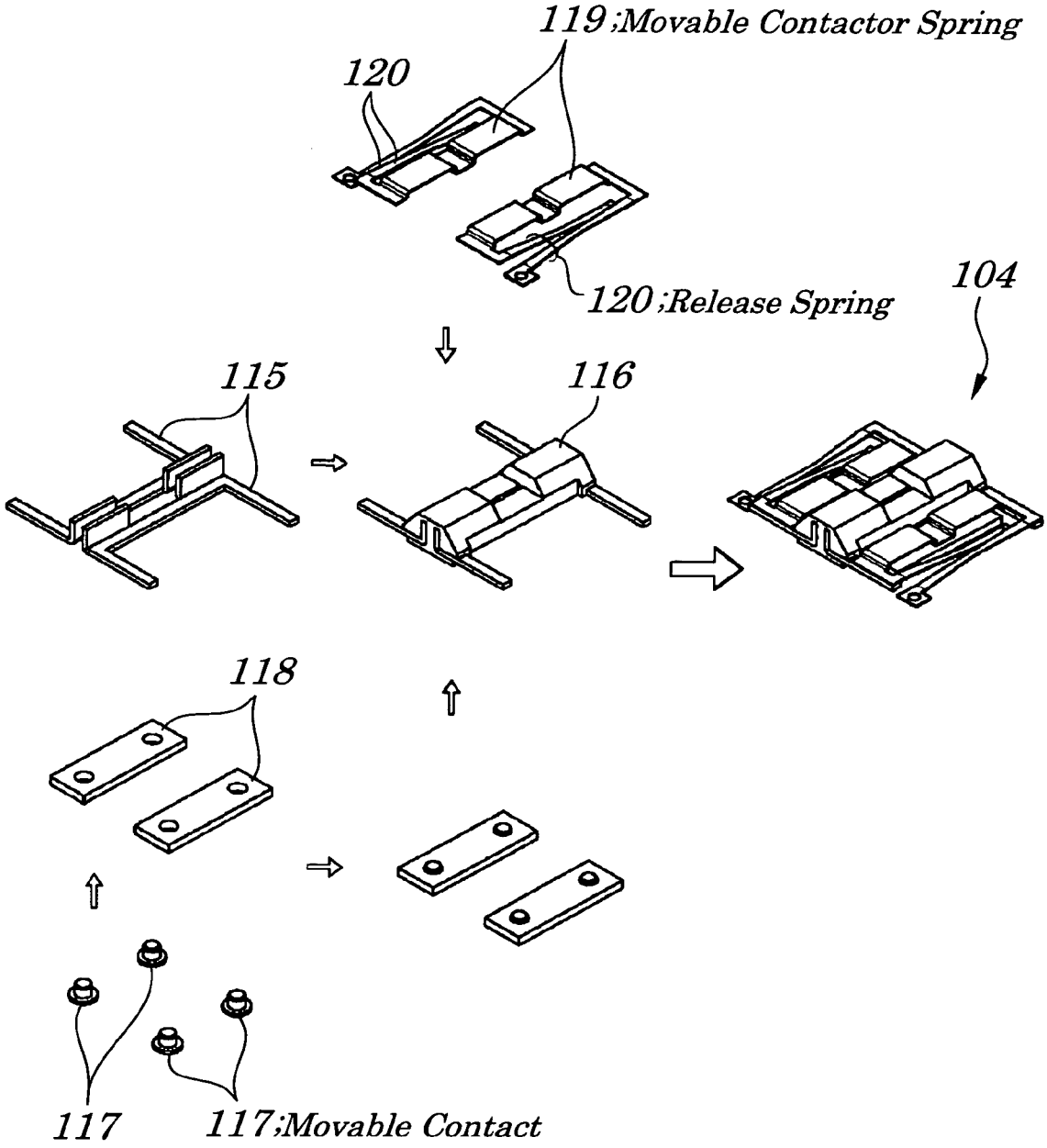
FIG. 4 is an exploded perspective view of a card block according to the same embodiment of the present invention.
Figure 5:
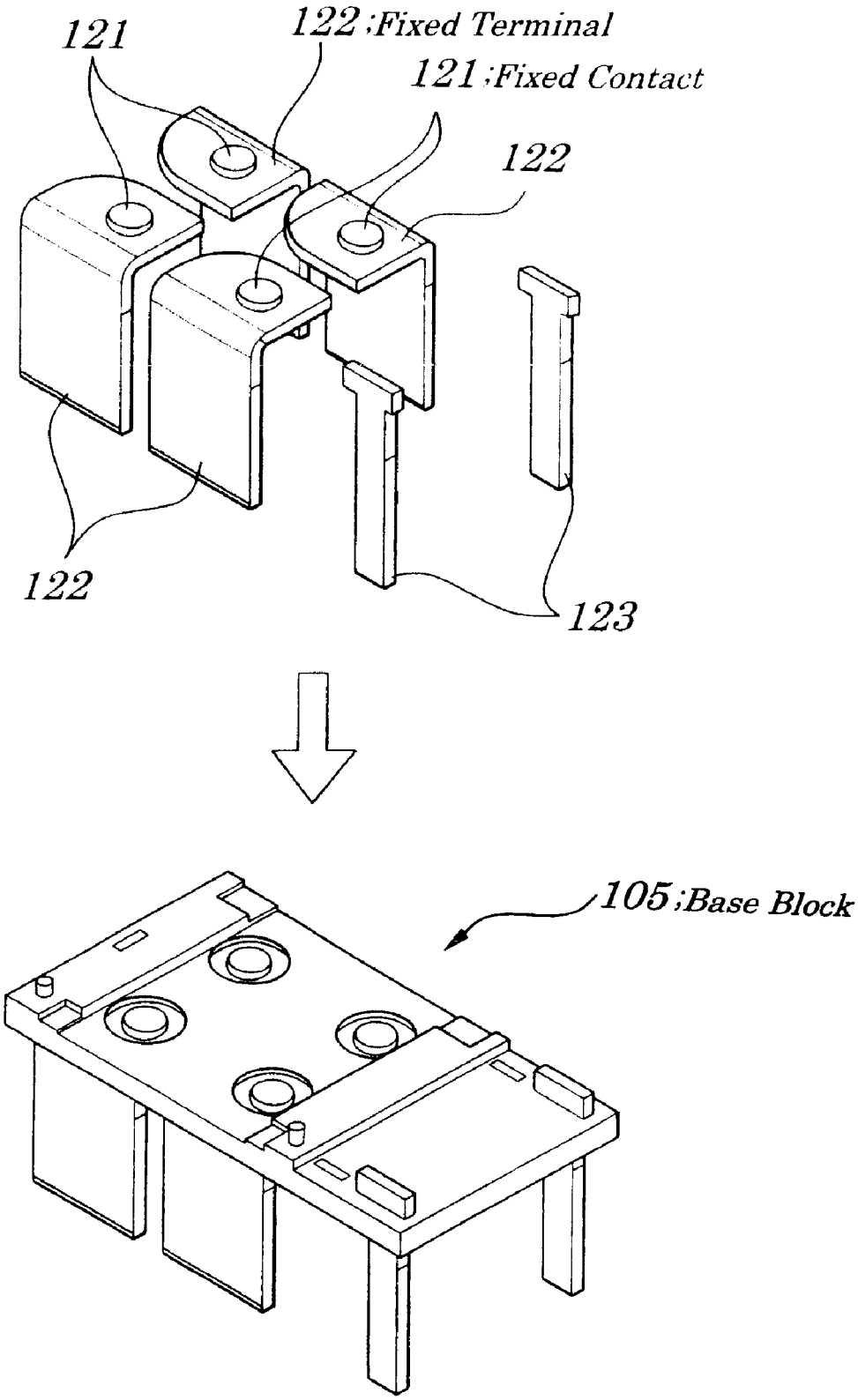
FIG. 5 is an exploded perspective view of a base block according to the same embodiment of the present invention.
Figure 6:
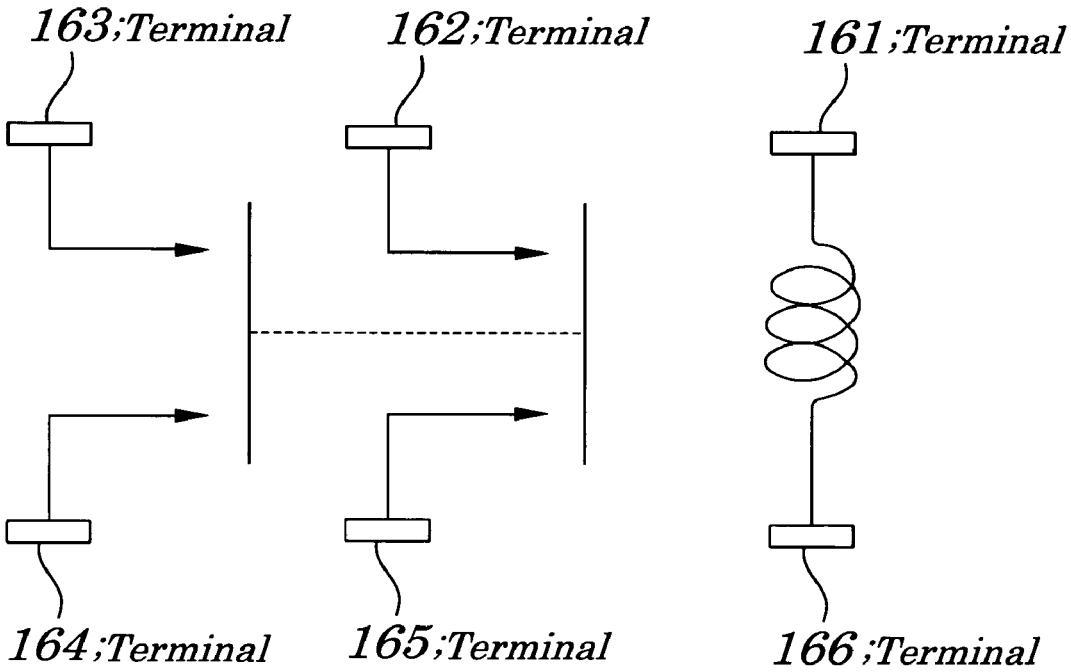
FIG. 6 is a diagram illustrating a circuit and terminal according to the same embodiment of the electromagnetic relay.

Best modes of carrying out the present invention will be described in further detail using various embodiments with reference to the accompanying drawings. FIG. 1 is a perspective view of an electromagnetic relay according to a preferable embodiment of the present invention. FIG. 2 is an exploded perspective view of a main body 101 of the electromagnetic relay according to the same embodiment. FIG. 3 is an exploded perspective view of an electro-magnet block 103 according to the same embodiment. FIG. 4 is an exploded perspective view of a card block 104 according to the same embodiment. FIG. 5 is an exploded perspective view of a base block 105 according to the same embodiment. FIG. 6 is a diagram illustrating a circuit and terminals of the electromagnetic relay. In FIG. 6, terminals 161 and 166 are connected to a coil, terminals 162 and 165 are connected to a first ordinarily-open contact, and terminals 163 and 164 are connected to a second ordinarily-open contact.

As shown in FIG. 1, the electromagnetic relay according to the embodiment is made up of the main body (the electromagnetic relay proper) 101 and a cover 102 used to cover the main body (the electromagnetic relay proper) 101. The electromagnetic relay according to the embodiment, as shown in FIG. 2 includes the electro-magnet block 103, the card block 104, and the base block 105.

The electro-magnet block 103, as shown in FIG. 3, is made up of a coil 106, an iron core 107, a spool 108, a coil block 110 having bundle terminals 109, a yoke 111, an armature 112, a hinge spring 113, and supporting terminals 114.

More specially, the electro-magnet block 103, includes the iron core 106 around which a coil is wound, the L-shaped yoke 111 being attached to one end of the iron core 106, the approximately <-shaped armature 112 that is placed in a position being opposite to another end of the iron core 106 and is attracted by the energized iron core 106, and the hinge spring 113 that supports the armature 112 in such a manner that the armature 112 is capable of rocking or swinging.

The card block 104 includes, as shown in FIG. 4, a card 116 having a pair of ⊐-shaped holding frame 115 electrically separated and being mechanically connected by an insulating material such as a highly heat-resistant resin, ceramic, glass, or composite of these materials, a pair of movable contactors 118 to each of which two movable contacts 117 are joined, a pair of movable contactor springs 119 being joined to the ⊐-shaped holding frames 115, and a pair of release springs 120 to return the movable contactors 118 from an operating state to a released state.

The base block 105, as shown in FIG. 5, is constructed so as to integrally form four fixed terminals 122 to which fixed contacts 121 are attached in a fixed manner and two coil terminals 123 using a highly heat-resistant resin.

The four movable contacts 117 of the card block 104 are placed approximately in one plane, and the four fixed contacts 121 each are placed in positions facing a corresponding one of the four movable contacts 117 on the base block 105, and the four movable contacts 117 and four fixed contacts 121 are simultaneously opened and closed in synchronization with the rock or swing of the armature 112.

The movable contactor springs 119, as shown in FIG. 4, are bow-shaped with the thick-plate shaped movable contactors 118 being attached thereto in its central portion in a fixed manner. By attaching a center portion of the bow-shaped movable contactor springs 119 to a center portion of the movable contactors 118 in a fixed manner, freedom of movement occurs between two movable contacts 117 mounted within each movable contactors 118, which accommodates an error in manufacturing and decreases variations in contacting strength between contacts to obtain stability of contact resistance. The movable contactor springs 119 with the movable contactors 118 being attached thereto in a fixed manner are affixed to the holding frame 115. In the movable contactor springs 119, a part (an added portion being placed orthogonal approximately to a ⊐-shaped (C-shaped) surface) of the holding frame 115 being bent in an L-shaped form in a highly heat-resistant resin, ceramic, glass, or composite of these materials is integrally formed and, therefore, tilt deformation of the card 116 caused by contacting force occurring at time of operations can be suppressed.

The release springs 120 are plate-shaped rectangular springs being bent slightly in their center portions and are attached to the holding frame 115 and may be formed integrally with the movable contactor springs 119 to reduce component counts. The two release springs 120 are placed in parallel in a direction being reverse to each other and cross each other when seen from a side and make up one set as a whole. One of the two release springs 120 is supported by the base block 105 in a fixed manner and another is supported on the base bock 105 in a movable manner. Similarly, another one set of the release springs 120 is placed around the card 116 in a manner being symmetric with respect to a line. Thus, by supporting one end of the release springs 120 in a fixed manner, it is possible to improve anti-vibration and anti-shock capabilities.

To reduce contact resistance value between fixed terminals 122, as shown in FIG. 5, each of the fixed terminals 122 are made large in width and in thickness of its plate, and a cross-sectional area thereof is made as large as possible and a copper alloy having as high a conductivity as possible is used. Moreover, to reduce resistance of a conductor between one fixed contact and another fixed contact, as shown in FIG. 4, the movable contactors 118 with a minimum length and a maximum cross-sectional area, which are made of a copper alloy having a high conductivity, is used.

Figure 7A:
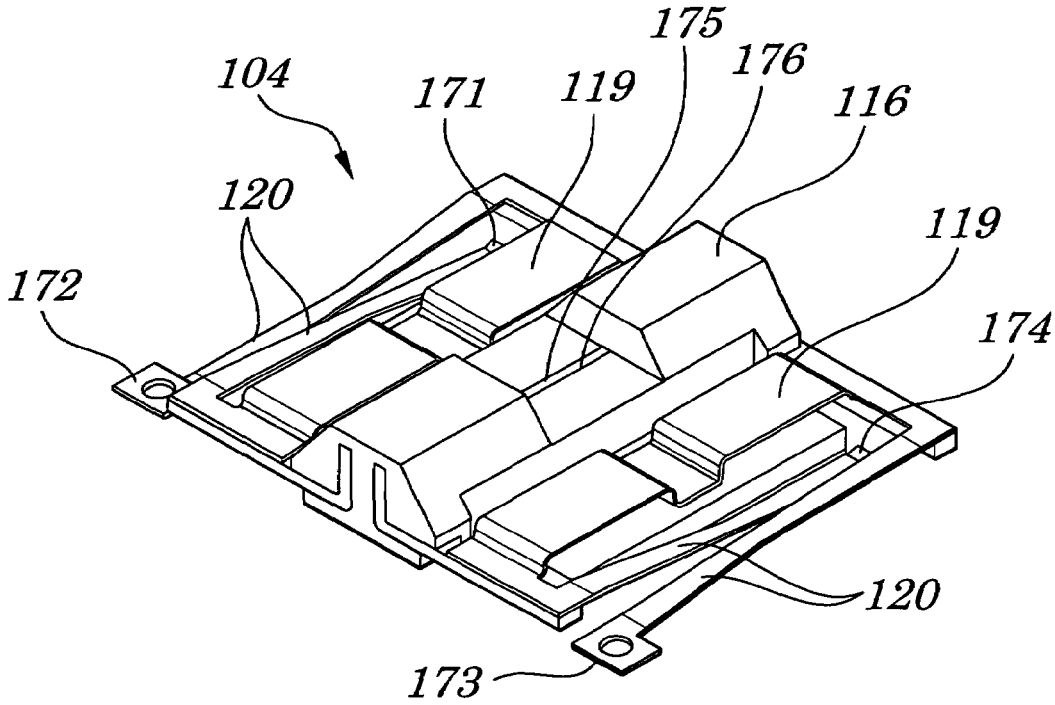
FIGS. 7A and 7B are diagrams for explaining operations of the card block according to the same embodiment of the electromagnetic relay.
Figure 7B:
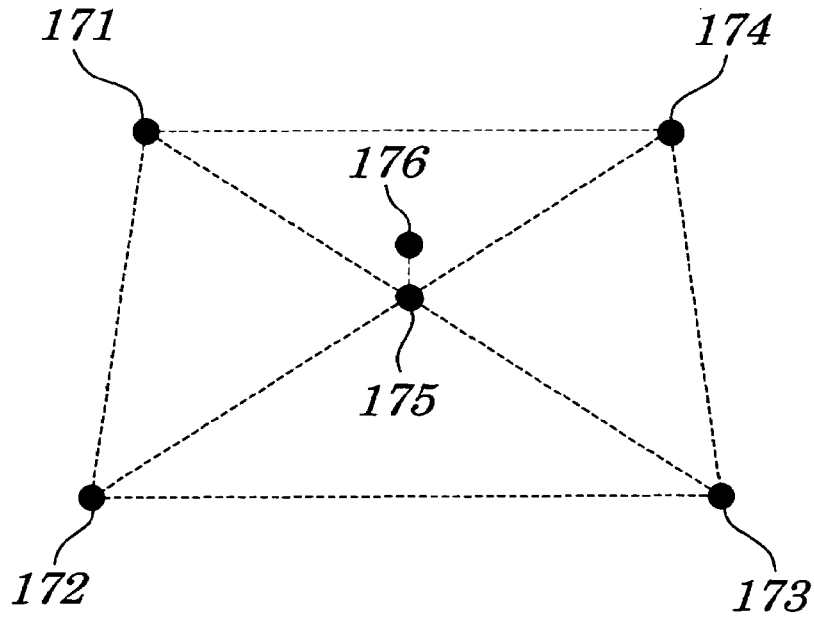

Operations of the card block 104 are elaborated on by referring to FIG. 7. FIGS. 7A and 7B are diagrams explaining operations of the card block 104 and FIG. 7A is a perspective view of the card block 104 and FIG. 7B is a schematic diagram showing supporting points 171, 172, 173, and 174 of the release springs 120 and a pressure point 176 of the card 116 by an armature.

The card block 104 is supported at four points including base fixed supporting points 172 and 173 and movable supporting points 171 and 174. On the other hand, the card block 104 is pressed down by the armature through the pressure point 176 in a groove in a center portion of the card 116. At this time, by displacing the pressure point 176 from a center point of the card block 104 to a side of a straight line connecting two movable supporting points 171 and 174, a balance of a force can be maintained. The reason is that, if the card block 104 is pressed down at a center point 175, restoring force of the release springs 120 being supported at the movable supporting points 171, 174 and the restoring force, due to friction resistance caused by sliding is smaller than restoring force of the base supported at the fixed supporting points 172, 173 and, therefore, the card block 104 is caused to be inclined.

Moreover, by adding contrivance to a shape of the release springs 120, the card block 104 can be operated in a stable manner. That is, by making a width of a plate of the release springs 120 on a fixed supporting side larger than that of the release springs 120 on a movable supporting side, up-and-down movements can be made in a stable manner. To make a length of the release springs 120 on the fixed supporting side larger than that of the release springs 120 on the movable supporting side is also effective.

Thus, an electromagnetic relay is obtained which is as small as 18 mm in width×32 mm in length×17 mm in height and is capable of controlling two circuits and having a large current-carrying capacity of 100A-120s and high interrupting capability and being excellent in resistance against shock and vibration.

It is apparent that the present invention is not limited to the above embodiments but may be changed and modified without departing from the scope and spirit of the invention.

What is claimed is:

1. An electromagnetic relay comprising:

an electro-magnet block having an iron core around which a coil is wound, a yoke being attached to one end of said iron core, an armature that is placed in a position being opposite to another end of said iron core and is attracted by the energized iron core, and a hinge spring that supports said armature in such a manner that said armature is capable of rocking or swinging;

a card block which comprises a pair of holding frames each being electrically separated and being mechanically connected by an insulating material, a pair of movable contactor springs being joined to said holding frames, a pair of movable contactors being joined to each of said movable contactor springs and each having at least one movable contact in a fixed manner, and a pair of release springs to return said movable contactors from an operating state to a released state, said electro-magnet block being superposed over said card block with said armature engaging said card block at a pressure point; and a base block to support at least two fixed terminals each having a fixed contact and two coil terminals using an insulating material for a base, said card block being superposed over said base block; and wherein the at least two movable contacts of said card block are placed approximately in one plane and the at least two fixed contacts each are placed in positions facing a corresponding one of the at least two movable contacts on said base block, and the at least two movable contacts and the at least two fixed contacts are simultaneously opened and closed in synchronization with the rock or swing of said armature.

2. The electromagnetic relay according to claim 1, comprising:

said electro-magnet block having said iron core around which said coil is wound, an L-shape yoke being attached to one end of said iron core, an approximately <-shaped armature that is placed in a position being opposite to another end of said iron core and is attracted by said energized iron core, and said hinge spring that supports said armature in such a manner that said armature is capable of rocking or swinging;

said card block which comprises a pair of ⊐-shaped holding frames each being electrically separated and being mechanically connected by said insulating material, a pair of said movable contactor springs being joined to said ⊐-shaped holding frames, a pair of said movable contactors being joined to each of said movable contactor springs and each having two movable contacts in a fixed manner, and a pair of release springs to return said movable contactors from an operating state to a released state; and said base block to support four fixed terminals each having a fixed contact and two coil terminals using an insulating material for a base; and wherein the four movable contacts of said card block are placed approximately in one plane and the four fixed contacts each are placed in positions facing a corresponding one of the four movable contacts on said base block, and said four movable contacts and four fixed contacts are simultaneously opened and closed in synchronization with the rock or swing of said armature.

3. The electromagnetic relay according to claim 2, wherein said movable contactor spring is bow-shaped.

4. The electromagnetic relay according to claim 2, wherein said movable contactor comprises a thick plate.

5. The electromagnetic relay according to claim 2, wherein said movable contactor spring is attached in a center of said movable contactor.

6. The electromagnetic relay according to claim 2, wherein, in a portion in which said コ-shaped holding frames face each other is placed added portions being approximately orthogonal to surfaces including the コ-shaped portion.

7. The electromagnetic relay according to claim 2, wherein each of said pair of release springs comprises a first plate-like spring and a second plate-like spring and said first plate-like spring is attached in a fixed form to one arm portion of each of said コ-shaped holding frames and said second plate-like spring is attached in a fixed form to another arm portion of each of said コ-shaped holding frames and said first plate-like spring and said second plate-like spring are arranged in parallel and in a direction being reverse to each other.

8. The electromagnetic relay according to claim 7, wherein one end of said first plate-like spring is supported in a fixed manner on said insulating material for said base and one end of said second plate-like spring is supported in a movable manner while being slid on a surface of said insulating material for said base.

9. The electromagnetic relay according to claim 8, wherein a width of said first plate-like spring is larger than that of said second plate-like spring.

10. The electromagnetic relay according to claim 8, wherein a length of said first plate-like spring is larger than that of said second plate-like spring.

11. The electromagnetic relay according to claim 7, wherein said release springs are formed integrally with said movable contactor springs.

12. The electromagnetic relay according to claim 8, wherein a position of said pressure point used to transfer a movement of said contactor to said card block is deviated to a side of one end of said second plate-like spring, on which a pair of movable supporting points is located, relative to a center point of said card block.

13. The electromagnetic relay according to claim 2, wherein one end of a supporting terminal to fix said electromagnet block to a base block is fixed to the L-shaped yoke and another end of said supporting terminal is inserted into said base block by pressing and in a fixed manner.

14. The electromagnetic relay according to claim 2, wherein said insulating material for connection is made of a highly heat-resistant resin, ceramic, glass, or composite of these materials.

* * * * *